US005615737A

United States Patent [19]

Ables

[11] Patent Number: 5,615,737

[45] Date of Patent: Apr. 1, 1997

[54] APPARATUS FOR INSERTION OF FULL BORE TOOLS INTO AN EARTH BOREHOLE

[76] Inventor: Muriel W. Ables, 1026 Walter Dr., Breaux Bridge, La. 70517

[21] Appl. No.: 530,693

[22] Filed: Sep. 19, 1995

[51] Int. Cl.[6] ..... E21B 33/06

[52] U.S. Cl. ..... 166/85.4; 166/86.1; 166/86.2; 166/95.1

[58] Field of Search ..... 166/379, 385, 166/80.1, 85.4, 86.1, 86.2, 95.1

[56] References Cited

U.S. PATENT DOCUMENTS

| | | | |
|---|---|---|---|
| 1,635,749 | 7/1927 | Hosmer | 166/85.4 X |
| 2,889,886 | 6/1949 | Gould | 166/95.1 X |
| 4,553,591 | 11/1985 | Mitchell | 166/95.1 X |
| 4,828,024 | 5/1989 | Roche | 166/84.4 |
| 4,915,178 | 4/1990 | Goldschild | 166/385 |
| 5,178,215 | 1/1993 | Yenulis et al. | 166/95.1 |
| 5,465,788 | 11/1995 | Wright | 166/379 X |

*Primary Examiner*—Dennis L. Taylor
*Attorney, Agent, or Firm*—Jesse D. Lambert

[57] ABSTRACT

Apparatus for inserting full bore tools into an earth borehole, such as oil and gas wells, includes: a blowout preventer assembly superimposed on the wellhead of the borehole; a seal body having an internal concentric seal diameter, superimposed on the blowout preventer assembly; a tubular mandrel concentrically engaged with the seal diameter of said seal body, with a standpipe attached thereto; a tubular bell nipple connected to the seal body; and a pack-off assembly disposed between the internal diameter of the standpipe and a workstring inserted into the earth borehole.

The blowout preventer assembly, seal body, and bell nipple are typically installed on the wellbore when well operations commence. During ordinary, unpressurized wellbore operations a seal diameter protector may be installed in the seal body. When wellbore pressure is present or may be expected (such as operations conducted during underbalanced conditions), the seal diameter protector is removed, the tubular mandrel and standpipe sealingly engaged with the seal diameter of the seal body, and a pack-off assembly installed between the internal diameter of the standpipe and the workstring. The tubular mandrel and standpipe internal diameters are at least as large as the bore of the wellbore, permitting introduction of full bore tools into the wellbore. As no part of the apparatus extends into the blow-out preventer stack, there is no loss of blow-out preventer redundancy while using the apparatus.

17 Claims, 4 Drawing Sheets

APPARATUS FOR INSERTION OF FULL BORE TOOLS INTO AN EARTH BOREHOLE

BACKGROUND OF THE INVENTION

1. Field of the Invention

The invention relates to an apparatus providing a means for inserting a workstring into an earth borehole. With additional particularity, the invention relates to apparatus for passage of well tools from the surface of the earth into an earth borehole which is pressurized or may become pressurized during operations being conducted with the well tools. With greater particularity, the invention relates to a means for passage of full sized tools, that is, tools with outer diameters as large as the inner diameter of the borehole, into a pressurized or potentially pressurized earth borehole, without loss of pressure control, without the use of either the blind or annular blow-out preventers to prevent loss of pressure control, and without loss of redundant blow-out preventer protection in the event of an emergency condition. Such apparatus have particular, but not exclusive, utility in the fields of oil and gas exploration and production where highly pressurized flammable fluids may be encountered in the wellbore during various operations.

2. Description of the Prior Art

In the practice of drilling earth boreholes, subsurface pressures are most frequently controlled by the hydrostatic pressure of the wellbore fluid column, typically comprising drilling mud or completion fluid. As long as the hydrostatic pressure created by such wellbore fluid column is at least as great as the subsurface formation pressure, no formation fluid may flow into the borehole. However, situations arise where the subsurface formation pressure is greater than the hydrostatic fluid column pressure. This may be unintentional, where unexpectedly high subsurface pressures are encountered during well operations, or intentional, where an oil or gas zone to be produced is intentionally perforated in an "underbalanced" mode in order to prevent wellbore fluids, containing solid particulates, from flowing into the oil and gas zone and potentially damaging the ability of said zone to produce minerals. In other drilling, completing, or workover operations on an oil or gas well, it is often necessary to introduce workstrings (such as wireline, coiled tubing, or snubbing strings) conveying various tools (such as logging tools, perforation tools, nitrogen injection tools, etc.) into the wellbore under pressure, or at least when pressure conditions present a substantial risk of occurring. In situations where wellbore fluid pressure is insufficient to control fluid flow from a pressure bearing subsurface formation, alternative means must be relied on to control the subsurface pressure; the safety of the rig personnel, rig equipment, and the rig itself depend on this pressure control. The ability to control subsurface pressure is also critical to prevent the loss of valuable natural resources, such as oil and natural gas, and to prevent environmental pollution resulting from an uncontrolled fluid flow.

During normal drilling operations the weight of the wellbore fluid is typically adjusted ("weighted up") to produce wellbore hydrostatic fluid pressure that is higher than any formation pressure encountered, therefore the only surface equipment used to control wellbore pressure is a "blow-out preventer" assembly. Typically two different types of independently operable blow-out preventers are included in series, to provide a redundant safety system. One type of preventer typically included in a blow-out preventer assembly is an annular type which is capable of closing off the wellbore while no workstring is in the well; in addition, the annular preventer will close and seal around a workstring in the wellbore, without damaging the workstring. Another type of blow-out preventer typically included in a blow-out preventer assembly is a "blind" or "blind/shear" type, capable of completely closing the wellbore at the surface while no workstring is in the wellbore, or if a workstring is in the wellbore, sealing the well while crushing and/or shearing any pipe, wireline, or tubing that may be in the wellbore. Blind or blind/shear blow-out preventers are not capable of sealing a pressurized wellbore while at the same time allowing pipe, wireline, or tubing to be passed into the well, and annular blow-out preventers are subject to damage if used in this mode.

Rather, apparatus used to allow sliding passage of pipe, wireline, or tubing while simultaneously maintaining pressure seal of a wellbore are typically referred to as "pressure lubricators". While no representation is made thereto, the name of such equipment presumably emanates from the fact that some form of lubrication is typically applied at the sliding interface of the seal and wire or tubular being passed therethrough.

One conventional pressure lubricator configuration, such as disclosed in U.S. Pat. No. 4,836,289 to Young, includes an extended tubular with a flared lower end. The flared end of said tubular is lowered into the wellbore and the annular blowout preventer closed about the outer diameter of said tubular, to both hold it in place and to provide a lower pressure seal. A lock pin mandrel is installed atop the blowout preventer assembly, and lock pins in that mandrel are advanced into a mating profile on the tubular to further secure the tubular in place. The lock pins and the flared tubular end, when contacting the annular preventer element, prevent the tubular from being forced out of the well due to pressure from below. The annular blowout preventer necessarily must remain closed about this type of lubricator during operations therethrough. Disadvantages to this conventional design are several: the outer diameter of the tubular must be smaller than that of the inner diameter of the annular blowout preventers, thereby limiting the size of tools that may be inserted into the well, and use of the annular blow-out preventers to provide a lower lubricator pressure seal effectively disables that blow-out preventer from preventing escape of pressure at the top of the lubricator assembly, forcing reliance in such event solely on the blind or blind/shear rams, use of which will damage pipe, wireline or tubing extending therethrough when the blind rams are closed. Accordingly, by using the annular blow-out preventer to provide a pressure seal about the lubricator, not only is redundance of critical safety equipment lost, but use of the safety equipment which remains is likely to cause property damage. In addition, rig personnel must climb up on the blowout preventer and wellhead assembly or on scaffolding to manually access and advance the lock pins. This procedure is inherently unsafe.

Another type of lubricator assembly is disclosed in U.S. Pat. No. 4,553,591 to Mitchell, Nov. 19, 1985. In Mitchell a dual flanged spool is mounted between the annular blowout preventer and the bell nipple, a cylindrical wear bushing having an axial bore secured therein by radial pins, and a mandrel having an internal diameter less than the blow-out preventer bore diameter connected to the axial bore of the cylindrical bushing. The size of wireline tools that may be used with this mandrel in place is restricted, since Mitchell teaches that the internal diameter of the mandrel is less than the blowout preventer bore diameter in order to prevent "whipping" of pipe, wireline or tubing in the blowout preventers. Further, multiple lockdown pins must be manually advanced in the annular spool to engage the mandrel and cylindrical wear bushing. To advance the pins, one or more drilling rig personnel typically climb upon the blow-out preventer stack or make-shift boards and scaffolding placed around same, which may be at a great distance above ground or water level and too often presents a difficult, slippery, muddy surface to climb upon.

Neither of the aforesaid patents provide apparatus and method for providing a wellbore pressure seal which provide the advantages of:

i) having a full-bore inner diameter, at least as large as the wellbore diameter, so as to permit maximum workstring tool size passage therethrough;

ii) having a pressure seal at the lower end of the pressure control apparatus independent of the annular or ram-type blowout preventer, thereby retaining redundant blow-out prevention capability; and iii) being able to be installed entirely from the rig floor without removing existing equipment, thereby saving time and avoiding the necessity of rig personnel to climb upon and about the blowout preventer stack to manually advance lockdown screws or the like.

The invention disclosed herein represents a significant improvement over existing lubricator stack assemblies in that all of the aforesaid advantages, in combination, are embodied therein in an economically deployed, safe apparatus having few components.

OBJECTS OF THE INVENTION

The general object of the invention is to provide a new and improved means for insertion of full sized wellbore tools, by means of pipe, wire or tubing, into a wellbore, while the wellbore is potentially or actually under pressure at the surface.

One object of the invention is to provide a wellbore pressure seal during workstring operations without restricting tool size below restrictions imposed by the existing wellbore diameter. A further object of the invention is to eliminate the need to remove existing fluid handling equipment, in particular the bell nipple, to permit installation of a pressure control apparatus. Yet another object of the invention is to maintain operational safety by achieving a wellbore pressure seal during workstring operations without use of the existing annular blowout preventer. Yet a further object of the invention is to provide a pressure lubricator without loss of the ability to monitor the fluid level in the wellbore.

Still further objects of the invention are to: increase operational safety by eliminating the need for personnel to climb upon the blowout preventer assembly stack to manually install the pressure control equipment; reduce the chance of environmental pollution and the loss of natural resources; and provide an economical, durable, easy to use apparatus for accomplishing all of the other objects of the invention in combination.

SUMMARY OF THE INVENTION

The apparatus for inserting full bore tools into an earth borehole is generally characterized by:

1. a blowout preventer assembly comprising a blind and/or blind/shear ram and an annular blow-out preventer superimposed thereon;
2. a single flanged seal body having internal concentrically disposed axial threads and seal surfaces, superimposed on the annular blow-out preventer;
3. a bell nipple sealingly engaged with the seal body;
4. a tubular mandrel sealingly engaged with the inner threads and seals of the seal body, the mandrel having one or more standpipe sections extending upwardly therefrom;
5. a protector for the inner threads and seal surfaces of the single flanged seal body;
6. a tool for running and retrieving said protector;
7. means for forming a pressure seal between the inner diameter of said mandrel or standpipe and a workstring slidably disposed therein, superimposed at the top of the mandrel/standpipe assembly.

The single flanged seal body and the tubular mandrel and standpipe engaged therewith have inner diameters at least as great as the wellbore diameter, so that the apparatus provides no diameter restriction to insertion of tools into the wellbore. The bell nipple is attached to the upper end of the seal body, then the seal body is attached to the blowout preventer assembly by a flange. The seal body protector is in place in the seal body during drilling operations to protect the internal threads and seals.

To employ the apparatus, the seal body protector is removed using the running and retrieving tool. The tubular mandrel is secured in the seal body by means of a threaded connection, engaging resilient seals and providing a pressure seal between the pressure chamber and the seal body. If needed, standpipe sections are attached to the tubular mandrel by means of threaded connections. A packoff is then installed on the upper end of the tubular mandrel/standpipe assembly to achieve a pressure seal between the mandrel and the workstring contained therein, while permitting axial and rotational movement of the workstring within the mandrel assembly. The tubular mandrel and standpipe together with the upper packoff then define a pressure-tight cavity into which wellbore tools can be placed in preparation for insertion into or removal from the wellbore.

The invention permits use of wellbore tools with outer diameters limited only by the wellbore diameter. Further, the invention does not require removal of the bell nipple for installation. Also, the invention does not require the use of an annular or ram-type blowout preventer to axially secure the tubular mandrel and standpipe and to provide a pressure seal at the lower end of the tubular mandrel assembly, thereby retaining maximum blowout preventer assembly flexibility and permitting monitoring of the wellbore fluid level. Personnel safety is increased since installation of the apparatus is done entirely from the rig floor, without the need to climb the blowout preventer assembly stack beneath the rig floor to manually install the apparatus.

DESCRIPTION OF THE PREFERRED EMBODIMENT

The preferred embodiment of the present invention has seven major components, those being:

i) a seal body;

ii) a tubular mandrel;

iii) a bell nipple;

iv) a seal body protector;

v) a running and retrieving tool;

vi) a packoff; and vii) a blowout preventer assembly superimposed on a wellbore.

Figure 1:
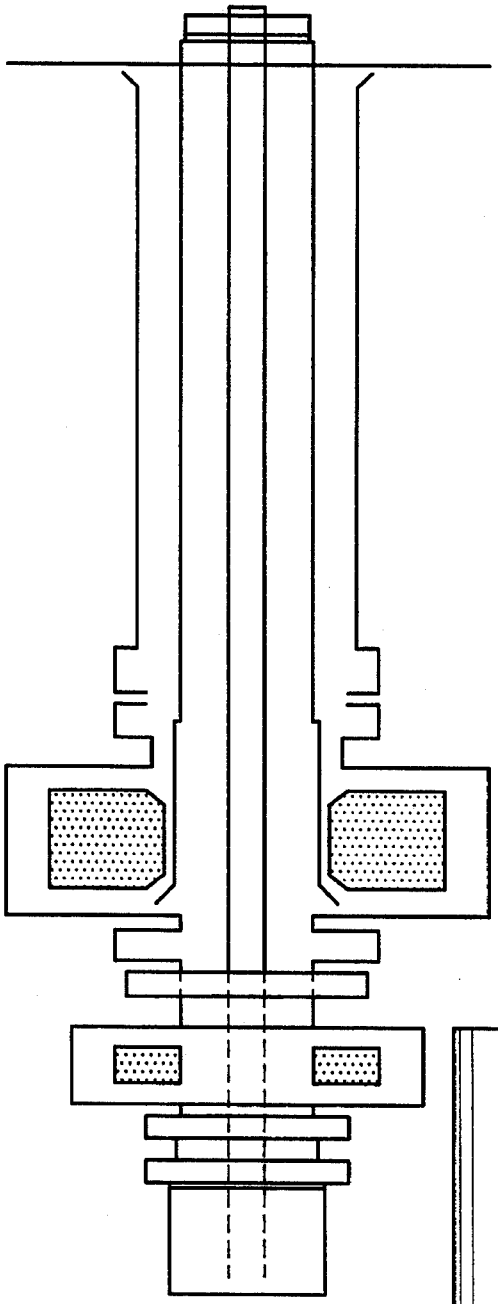
FIG. 1 PRIOR ART
FIG. 1 is an elevation view in cross section of a typical pressure lubricator assembly in conjunction with associated typical rig and well equipment.
Figure 2:
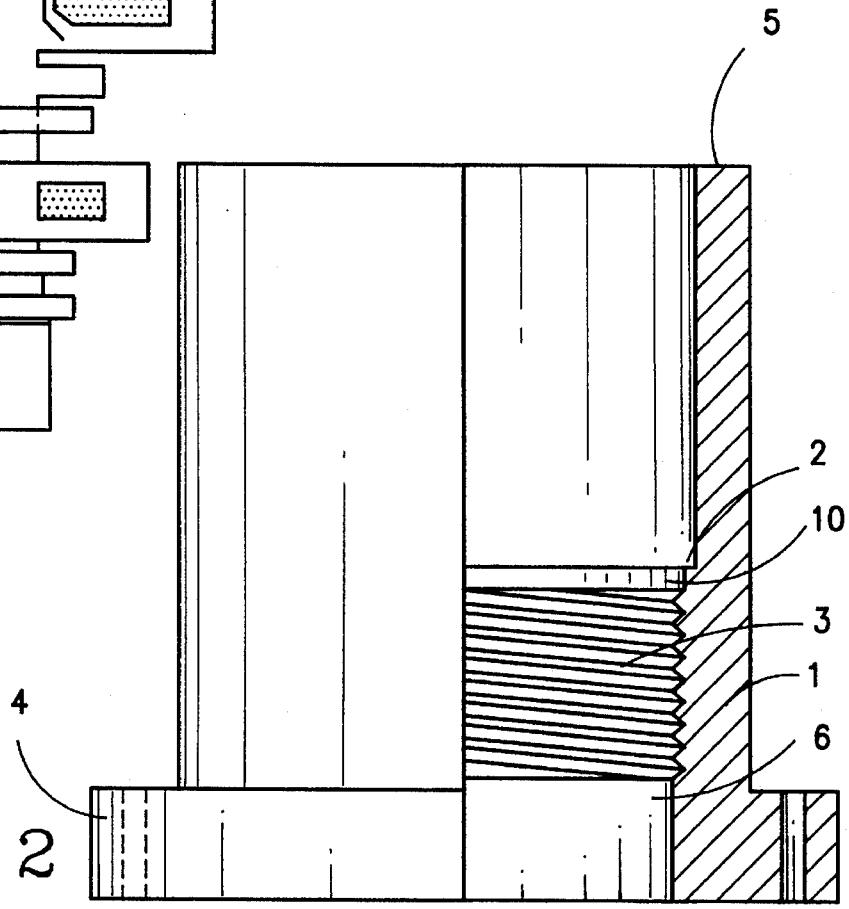
FIG. 2 is an elevation view in partial section of the seal body.

With reference to FIG. 2, the first main component is the seal body 1. The seal body 1 is generally cylindrical with a lower flange 4 for attaching the seal body to the blowout preventer assembly 39, the blowout preventer assembly having a fully penetrating concentric bore. The blowout preventer assembly is superimposed on a wellbore 40. The internal profile of the seal body 1 has a shoulder 2 for alternatively engaging the shoulder 12 of the tubular mandrel 7 or the shoulder 17 of the seal body protector 14. The internal profile of the seal body 1 further has a threaded section 3 for alternatively engaging the threads 13 of the tubular mandrel 1 or the threads 19 of the seal body protector 14. Although a threaded connection 3 is shown in the preferred embodiment, other types of connections, such as a snap-latch connection, could also be used. A seal area is provided at the upper end of the threaded section 10 for engaging a resilient seal. A seal area is provided at the lower end of the threaded area 6 for engaging one or more resilient seals. A conventional bell nipple 37 is attached to the upper end 5 of the seal body. A smooth surface for a welded connection is shown in the preferred embodiment, but a threaded connection or a snap-latch connection could also be used to connect the bell nipple 37 to the seal body 1. The internal diameter of the seal body is at least as great as the diameter of the wellbore to which it is attached.

Figure 3:
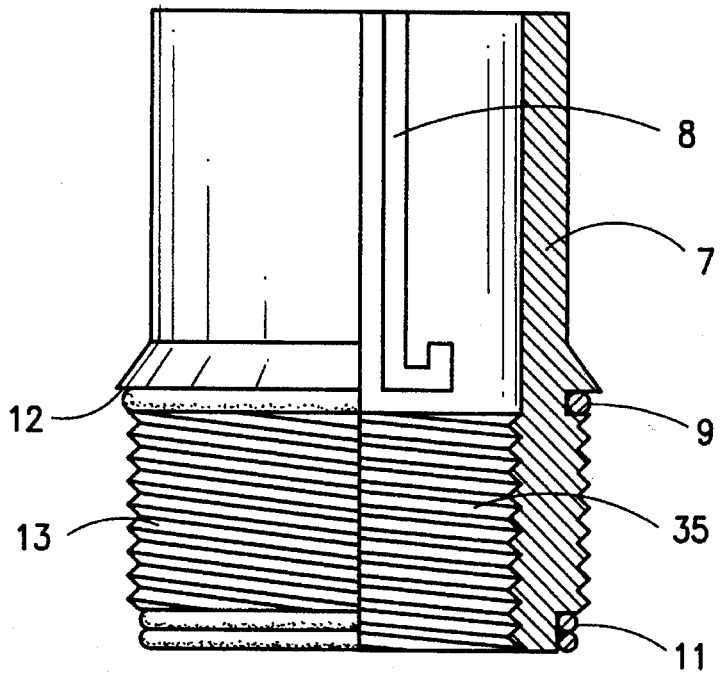
FIG. 3 is an elevation view in partial section of the tubular mandrel.
Figure 4:
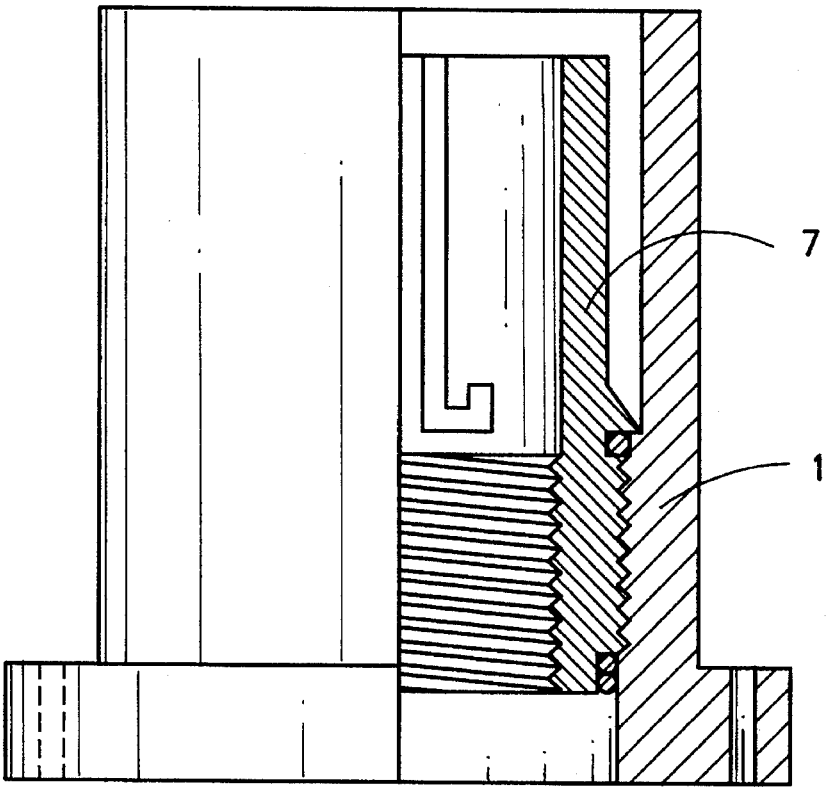
FIG. 4 is a detailed elevation view in partial section showing the tubular mandrel mounted in the seal body.
Figure 5:
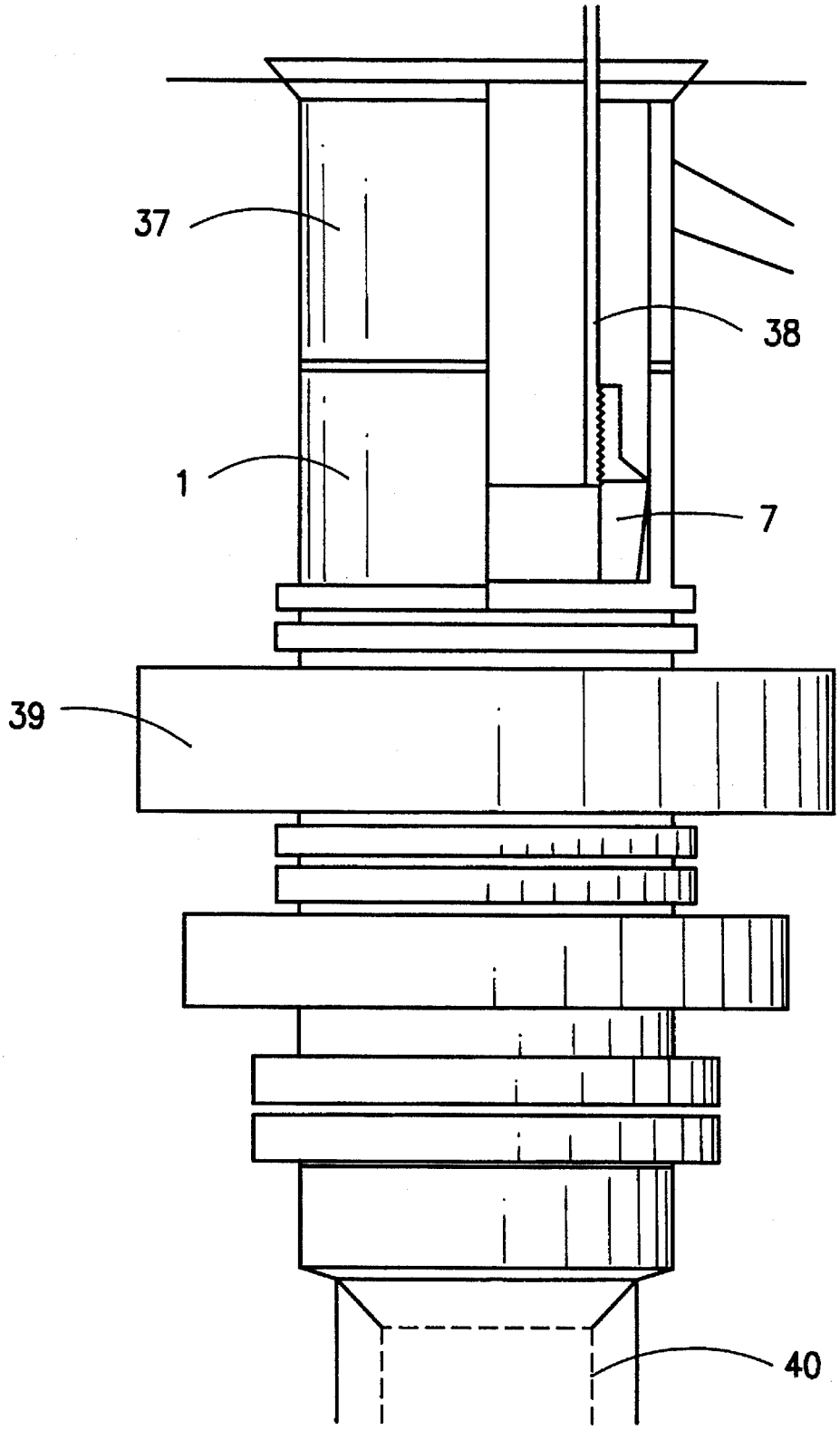
FIG. 5 is an elevation view in partial section of the seal body, tubular mandrel, standpipe, bell nipple, blowout preventer assembly, wellhead, and wellbore, all in place as for workstring operations.

With reference to FIG. 3, the second major component is the tubular mandrel, 7. The tubular mandrel 7 has a generally cylindrical shape with an internal diameter at least as great as the diameter of the wellbore. The tubular mandrel 7 includes a shoulder 12 having a lower surface for engaging the internal shoulder 2 of the seal body 1 to form a pressure seal. Resilient seals 9 and 11 on the tubular mandrel 7 engage seal areas 10 and 6, respectively, in the seal body 1 and form additional seals. The preferred embodiment employs O-ring seals, but other resilient seal configurations could be used as well, such as chevron-type seals. The external profile of the tubular mandrel 7 has a threaded section 13 for engaging the threaded section 3 in the seal body 1 forming a connection therebetween. The tubular mandrel 7 has a plurality of internal J-slots 8 to engage the lugs 21 on the running and retrieving tool 20. The upper internal section of the tubular mandrel 7 further has threads to engage a standpipe in the preferred embodiment. Although the preferred embodiment contemplates left hand threads, for certainty of removal of the tubular mandrel through the application of left hand torque to the tubular mandrel 7, right hand threads could be used as well. To use the tubular mandrel 7, one or more standpipe sections 38 are joined to the tubular mandrel 7 using the internal threads 35. A packoff assembly is attached to the upper end of the uppermost standpipe section 38 to effect a seal between the workstring and the tubular mandrel/standpipe assembly. The overall length of the tubular mandrel 7 and the standpipe sections 38 is dictated by the distance from the seal body 1 to the desired elevation above the rig floor. The tubular mandrel and standpipe assembly is then lowered into the bell nipple 37 until the external threads 13 on the tubular mandrel 7 engage the internal threads 3 in the seal body 1. The tubular mandrel/standpipe assembly is then rotated to advance the threads 13 on the tubular mandrel 7 into the seal body threads 3 until the shoulder 12 on the tubular mandrel 7 engages the internal shoulder 2 of the seal body 1. Additional torque is applied as appropriate to the tubular mandrel/standpipe assembly to energize the seals between the shoulders 2 and 12 and the resilient seals 9 and 11 with the matching seal areas 10 and 6 respectively. FIG. 4 shows the tubular mandrel 7 in place in the seal body 1. FIG. 5 shows the tubular mandrel 7 in place in the seal body 1 and additionally shows standpipe extensions 38 in place.

Figure 6:
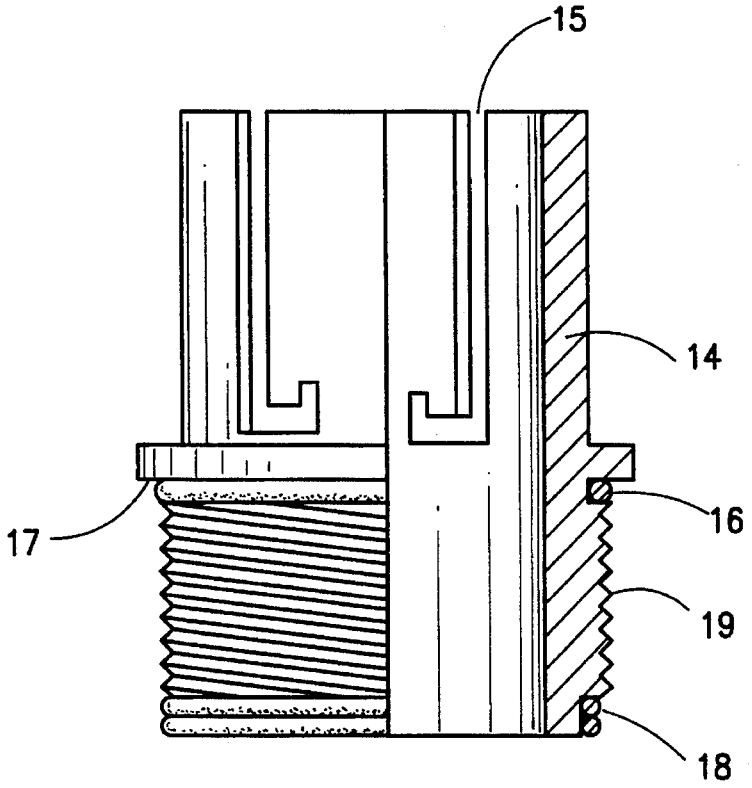
FIG. 6 is an elevation view in partial section of the seal body protector.

The next major component of the present invention is the seal body protector 14 shown in FIG. 6. This component is engaged in the seal body 1 while drilling operations are underway, instead of the tubular mandrel 7. The seal body protector is of a generally cylindrical shape, with an internal diameter at least as great as the wellbore diameter. The upper end of the seal body protector 14 has a plurality of J-slots 15 to engage the lugs 21 of the running and retrieving tool 20, the J-slots fully penetrating the wall of the seal body protector. The outer profile of the seal body protector 14 has a shoulder 17 to engage the internal shoulder 2 of the seal body 1, forming a pressure seal. Resilient seals 16 and 18 are provided to engage the seal areas 10 and 6, respectively, in the seal body 1 to form seals. In particular, these seals protect the seal body threads from the drilling muds and other abrasives encountered in the drilling process. Although the preferred embodiment shows O-ring seals, other resilient seal configurations could be used as well. An external threaded section 19 engages the internal threads 3 in the seal body 1 when the protector 14 is installed in the seal body 1. Alternative connections, such as snap-latch connections, could be employed in lieu of the threaded connection of the preferred embodiment.

Figure 7:
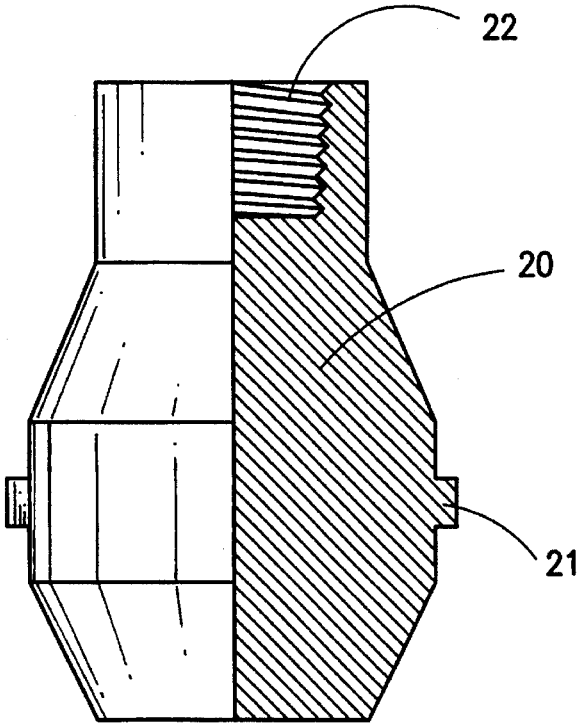
FIG. 7 is an elevation view in partial section of the running and retrieving tool for both the seal body protector and the tubular mandrel.

The running and retrieving tool 20 of FIG. 7 is the final major component in the preferred embodiment. The running and retrieving tool 20 has a generally tubular shape with a plurality of projecting lugs 21 on its external surface, to engage the J-slots 8 and 15 in the internal profiles of the tubular mandrel 7 and seal body protector 14, respectively. The upper end of the running and retrieving tool 20 has a cavity with internal threads 22 therein for engaging the pin connection of a typical drill pipe connection, to provide a means for lowering the running and retrieving tool into the bell nipple to engage, run, and retrieve the other components. Several configurations of lugs and mating J-slots could be employed, although the preferred embodiment shows a pair of lugs to engage a mating pair of J-slots in the component into which it fits. The maximum outer diameter of the body of the running and retrieving tool 20 is slightly less than the inner diameter of the components into which it fits.

Various other uses and modifications of the present invention will occur to those skilled in the art. For example, instead of the threaded connection joining the seal body and, alternatively, the seal body protector and the tubular mandrel, other connections could be used, such as a snap-latch connection. Further, the connection between the seal body and the bell nipple could be a snap-latch or a threaded connection as alternatives to the welded connection specified in the preferred embodiment. Further still, the invention could be used in drill pipe, wireline, coiled tubing, snubbing string, or other workstring operations by using the appropriate upper packoff means.

Accordingly, the foregoing description should be regarded as only illustrative of the invention, whose full scope is measured by the following claims.

I claim:

1. An apparatus for introducing full bore tools into earth boreholes, comprising:

a blowout preventer assembly sealingly superimposed on an earth borehole with a bore diameter, said blowout preventer assembly having a concentric fully penetrating bore with a diameter, said blowout preventer assembly further having an upper end with a flange connected thereto and concentric with said bore;

a seal body of a generally cylindrical shape having first and second ends, said first end having a flange connected concentrically thereto, said flange superimposed concentrically on said flange on said blowout preventer assembly and fastened thereto to form a pressure seal therebetween, said seal body having an inner diameter at least as large as said diameter of said bore of said earth borehole, said seal body having one or more internal circumferential seal surfaces;

a tubular bell nipple concentrically connected end-to-end to said second end of said seal body and forming a pressure seal therebetween;

a tubular mandrel having first and second ends and a fully penetrating concentric bore with a diameter at least as great as said diameter of said earth borehole, said first end having one or more external circumferential seal elements;

means for connecting said first end of said tubular mandrel within said seal body, holding said seal elements in contact with said seal surfaces and forming a pressure seal therebetween; and sealing means connected to said second end of said tubular mandrel forming a pressure seal between said tubular mandrel and a workstring contained therein, said sealing means permitting axial and rotational movement of said workstring within said tubular mandrel.

2. The apparatus for introducing full bore tools into earth boreholes as recited in claim 1, wherein said tubular mandrel comprises a plurality of tubular sections connected concentrically end-to-end.

3. The apparatus for introducing full bore tools into earth boreholes as recited in claim 1, further comprising:

a seal body protector having a generally cylindrical shape with a fully penetrating, concentric bore and one or more external circumferential seal elements;

means for connecting said seal body protector within said seal body, said seal body protector thereby covering said internal seal surfaces in said seal body, said external seal elements sealingly contacting said seal surfaces in said seal body; and means for installing and retrieving said seal body protector.

4. The apparatus for introducing full bore tools into earth boreholes as recited in claim 3, wherein said means for connecting said seal body protector within said seal body comprises a mated threaded connection, said seal body protector further comprising two or more internal J-slots spaced radially about said bore of said seal body protector, and wherein said means for installing and retrieving said seal body protector comprises an installation and retrieving tool of a generally cylindrical shape, said installation and retrieving tool having two or more external projecting lugs for engaging said internal J-slots in said bore of said seal body protector.

5. The apparatus for introducing full bore tools into earth boreholes as recited in claim 1, wherein said means for connecting said first end of said tubular mandrel within said seal body comprises a mated threaded connection.

6. The apparatus for introducing full bore tools into earth boreholes as recited in claim 5, wherein said tubular mandrel further comprises two or more internal J-slots spaced radially about said bore of said tubular mandrel.

7. The apparatus for introducing full bore tools into earth boreholes as recited in claim 6, further comprising an installation and retrieving tool of a generally cylindrical shape, said installation and retrieving tool having two or more external projecting lugs for engaging said internal J-slots in said bore of said tubular mandrel.

8. The apparatus for introducing full bore tools into earth boreholes as recited in claim 1, wherein said means for connecting said first end of said tubular mandrel within said seal body comprises a snap latch connection.

9. The apparatus for introducing full bore tools into earth boreholes as recited in claim 1, wherein said external circumferential seal elements on said first end of said tubular mandrel comprise resilient seal elements.

10. The apparatus for introducing full bore tools into earth boreholes as recited in claim 9, wherein said resilient seal elements comprise O-rings.

11. The apparatus for introducing full bore tools into earth boreholes as recited in claim 1, wherein said external circumferential seal elements on said first end of said tubular mandrel comprise metal seal elements.

12. An apparatus for introducing full bore tools into earth boreholes, comprising:

a blowout preventer assembly sealingly superimposed on an earth borehole with a bore diameter, said blowout preventer assembly having a concentric fully penetrating bore with a diameter, said blowout preventer assembly further having an upper end with a flange connected thereto and concentric with said bore;

a seal body of a generally cylindrical shape having a first end with a flange connected concentrically thereto, said flange superimposed concentrically on said flange on said blowout preventer assembly and fastened thereto to form a pressure seal therebetween, said seal body having an inner diameter at least as large as said diameter of said earth borehole, said seal body having internal concentric threads for alternatively matably connecting therein a tubular mandrel and a seal body protector, said seal body having upper and lower internal seal surfaces and an upwardly facing internal seating shoulder, said seal body having a second end for a welded connection to a bell nipple;

a tubular mandrel of a generally cylindrical shape having a first end, a second end, and a fully penetrating concentric bore with a diameter at least as great as said diameter of said bore of said earth borehole, said second end having external threads for matably engaging said internal threads in said seal body, said tubular mandrel having an downward facing external seating shoulder for engaging said internal seating shoulder in said seal body and forming a pressure seal therebetween, said second end having an upper O-ring circumferentially mounted thereon for engaging said upper internal seal area in said seal bore, forming a pressure seal thereby, said second end having dual lower O-rings mounted circumferentially thereon for engaging said lower internal seal surface in said seal body, forming a pressure seal therebetween, said first end having internal concentric threads therein;

a standpipe having first and second ends and a concentric fully penetrating bore with a diameter at least as great as said diameter of said earth borehole, said first end of said standpipe having external threads matably engaging said internal threads in said tubular mandrel;

sealing means connected to said second end of said standpipe forming a pressure seal between said standpipe and a workstring contained therein, said sealing means permitting axial and rotational movement of said workstring within said standpipe.

13. The apparatus for introducing full bore tools into earth boreholes recited in claim 12, wherein said standpipe comprises multiple tubular sections connected concentrically end-to-end.

14. The apparatus for introducing full bore tools into earth boreholes recited in claim 12, further comprising:

a seal body protector having a generally cylindrical shape with a fully penetrating, concentric bore, one or more external circumferential seal elements, and external concentric threads for matably connecting to said internal threads in said seal body, said seal body protector thereby covering said internal seal surfaces in said seal body, with said seals sealingly contacting said seal surfaces; and means for installing and retrieving said seal body protector.

15. The apparatus for introducing full bore tools into earth boreholes recited in claim 14, wherein said seal body protector further comprises at least two internal J-slots spaced radially about said bore of said seal body protector.

16. The apparatus for introducing full bore tools into earth boreholes recited in claim 15, wherein said means for installing and retrieving said seal body protector comprises an installation and retrieving tool, said installation and retrieving tool having a generally tubular shape with at least two external projecting lugs for engaging said internal J-slots in said seal body protector.

17. The apparatus for introducing full bore tools into earth boreholes recited in claim 12, wherein said tubular mandrel further comprises at least two internal J-slots spaced radially about said bore of said tubular mandrel, said apparatus further comprising an installation and retrieving tool having a generally tubular shape with at least two external projecting lugs for engaging said internal J-slots in said tubular mandrel.

* * * * *